US006010413A

United States Patent [19]

Pan-Chung

[11] Patent Number: 6,010,413

[45] Date of Patent: Jan. 4, 2000

[54] GOLF TEE

[76] Inventor: Lin Pan-Chung, 1F, No. 50, Tungshih Street, Hsichih Town, Taipei Hsien, Taiwan

[21] Appl. No.: 09/105,794

[22] Filed: Jun. 26, 1998

[51] Int. Cl.[7] ..... A63B 57/00

[52] U.S. Cl. ..... 473/402; 473/387

[58] Field of Search ..... 473/387–403

[56] References Cited

U.S. PATENT DOCUMENTS

| | | | |
|---|---|---|---|
| 1,410,483 | 3/1922 | Lard | 473/390 |
| 2,018,146 | 10/1935 | Penny | 473/402 |
| 4,192,504 | 3/1980 | Clugage | 473/403 |
| 4,783,077 | 11/1988 | Lemon | 473/402 |
| 4,951,945 | 8/1990 | Gamble | 473/400 |

*Primary Examiner*—Steven Wong
*Attorney, Agent, or Firm*—W. Wayne Liauh

[57] ABSTRACT

A golf tee, which is decomposable in the soil, comprises a lower penetration portion with a sharp cone-shaped tip and an upper carrier portion connected with the penetration portion for carrying a golf ball thereof on top. The penetration portion further has a plurality of exterior reinforce ribs located length-wise to the tip. The carrier portion further has a round hollow cross section and has a plurality of interior radial reinforce thin walls to divide the interior space of the carrier portion into several sub-spaces. The golf tee is characterized in that, while in a driving operation, the carrier portion will deform elastically and accordingly to a club strike.

1 Claim, 2 Drawing Sheets

GOLF TEE

BACKGROUND OF THE INVENTION (1) Field of the Invention

The invention relates to a golf tee, and more particularly to a golf tee which can firmly stand on the ground and can deform accordingly while being teed off, for reducing the driving resistance to a minimum.

(2) Description of the Prior Art

Conventional golf tee is made of plastics or wood, usually manufactured by extrusion or by machining, respectively. Plastic golf tee in the art is shaped as a solid cylinder with a sharp lower end and an enlarged top end. While driving a golf ball using a club, the club head will hit the ball and the top end of the tee at the same time. As a result, the top end of the golf tee will react to the club head and generate a resistant force. Such a resistant force will result in a dampening in the driving force and, will shorten the driving distance of the golf ball. In addition, the configuration of the conventional golf tee is a cylinder which makes the golf tee unstable in the ground. Sometimes, the golf tee will shake or tilt during a driving operation, which will affect the driving accuracy and make the flight of golf ball unpredictable.

To overcome aforesaid disadvantage in conventional golf tee, the effort to develop a new golf tee is definitely necessary.

SUMMARY OF THE INVENTION

Accordingly, it is a primary object of the present invention to provide a golf tee which can steadily in the ground and cause a minimum interference to a club strike.

The golf tee in accordance with the present invention comprises a lower penetration portion and an upper carrier portion. The penetration portion is used to pierce into the soil and steadily sustain the golf tee. The carrier portion is elastic for minimizing the effect of the reaction resistance on a golf ball while in a driving operation.

According to the present invention, the penetration portion of the golf tee has a lower sharp cone-shaped tip, and extends upward to connect with the carrier portion of the golf tee which is used to carry a golf ball above the ground. On the exterior of the penetration portion, a plurality of reinforcing ribs are located length-wise and extend from the bottom of the carrier portion all the way to the tip of the penetration portion.

The carrier portion connecting with the penetration portion has a round hollow cross section with a plurality of interior radial reinforcing thin walls to divide the interior space of the carrier portion into several subspaces. Such a design of interior sub-spacing in the carrier portion allows he golf tee to be elastic in its upper portion. While in a driving operation, the carrier portion will deform in response to a club strike for reducing the resistance to the club head and making a longer driving distance possible.

While inserting the penetration portion into the soil, the reinforcing ribs thereof will prevent the golf tee from tilting and make it stand.

The radial reinforcing thin walls inside the carrier portion provide both the reinforcement of the structure and the necessary elasticity to the golf tee for minimizing the resistance to a club strike.

The golf tee in accordance with the present invention not only has improved strength for practical application, it can also minimize the ill-effect on the driving distance of the golf ball during a ball driving.

All these objects are achieved by the golf tee described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 3:
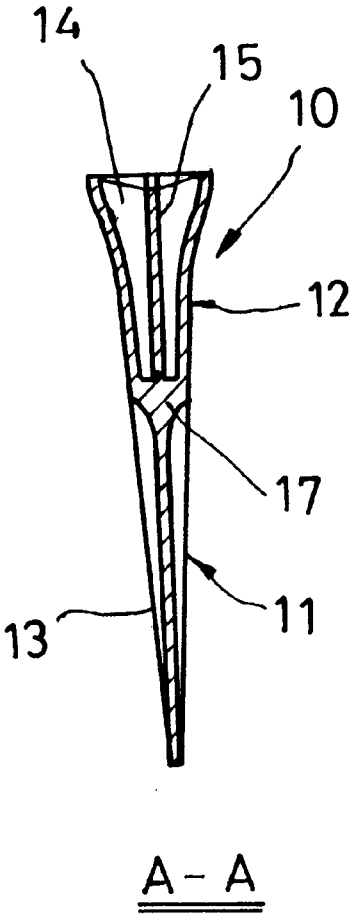
FIG. 3 is a cross section view of the preferred golf tee along the A—A line shown in FIG. 2.
Figure 2:
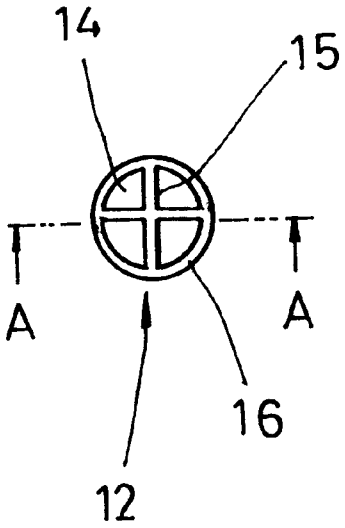
FIG. 2 is a top view of the preferred golf tee in accordance with the present invention.
Figure 1:
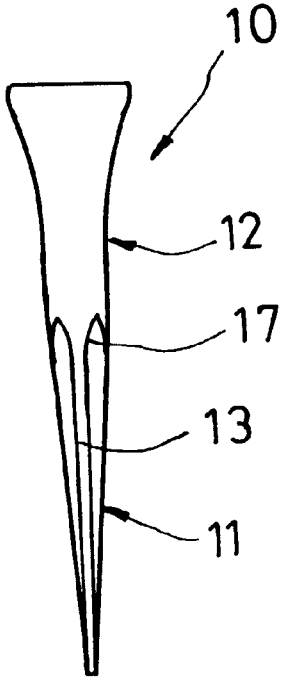
FIG. 1 is a perspective view of the preferred golf tee in accordance with the present invention.

The invention disclosed herein is directed to a golf tee. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

The golf tee 10 in accordance with the present invention comprises a penetration portion 11 having a lower sharp cone-shaped tip for piercing into the soil, and a carrier portion 12 connecting with the penetration portion 11 for providing a golf ball carrying space thereof on top.

The penetration portion 11 according to the present invention further includes a plurality of exterior reinforce ribs 13 located length-wise and extending from the bottom of the carrier portion 12 all the way to the tip of the penetration portion 11. The carrier portion 12 connecting with the penetration portion 11 has a round hollow cross section with a plurality of interior radial reinforce thin walls 15 to divide the interior space of the carrier portion 12 into several sub-spaces 14. The sub-spaces 14 and the interior radial reinforce thin walls 15 make the golf tee 10 deformed upon a strike of a club head 30.

The upper portion of the exterior reinforce ribs 13 are formed as curve shapes 17 to smoothly connect with the carrier portion 12. The carrier portion 12 is a cylindrical shell with a bottom and with a larger upper portion. On top of the carrier portion 12 is a concave surface for carrying a golf ball 20. Preferably, the interior radial reinforce thin walls 15 form a cross shaped division inside the carrier portion 12 and forms four subspaces 14. By providing the radial reinforce thin walls 15 and the subspaces 14, the carrier portion 12 will deform accordingly upon a strike of a club head 30 for minimizing the resistance to a club strike.

Preferably, the penetration portion 11 and the carrier portion are made as a whole, and can be made of material decomposable to the soil. Therefore, a golf tee 10 left in the golf field will be consumed by the insects or bugs, or by the naturally decomposed into the soil.

The decomposable material can be a decomposable starch resin or the like. The decomposable starch resin is composed (by weight) of 40–60% starch, 5–15% fat, 0.5–2% water, 3–10% PE, 2–8% protein, 10–25% EAA, 5–10% mountain soil, and resin.

Figure 4:
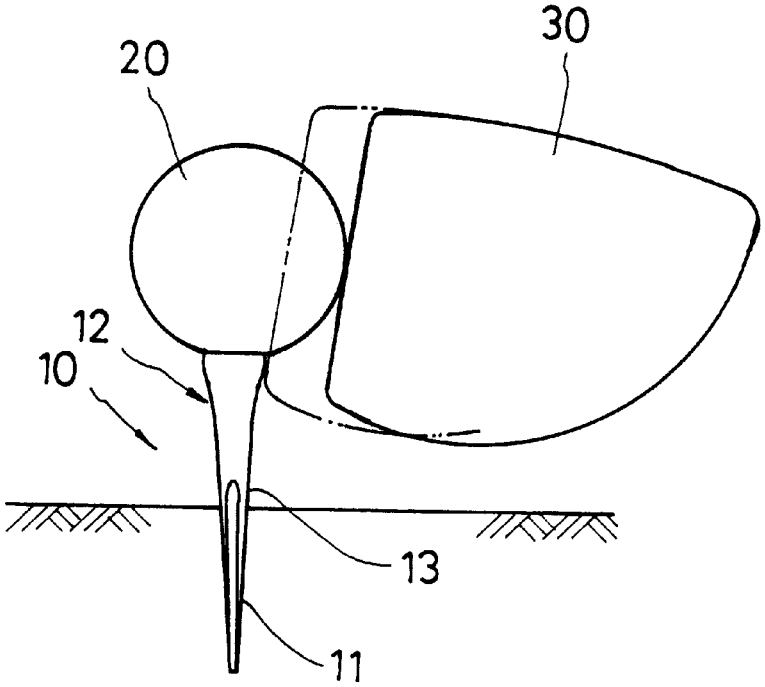
FIG. 4 is a side view of the preferred golf tee according to the present invention in a driving operation.
Figure 5:
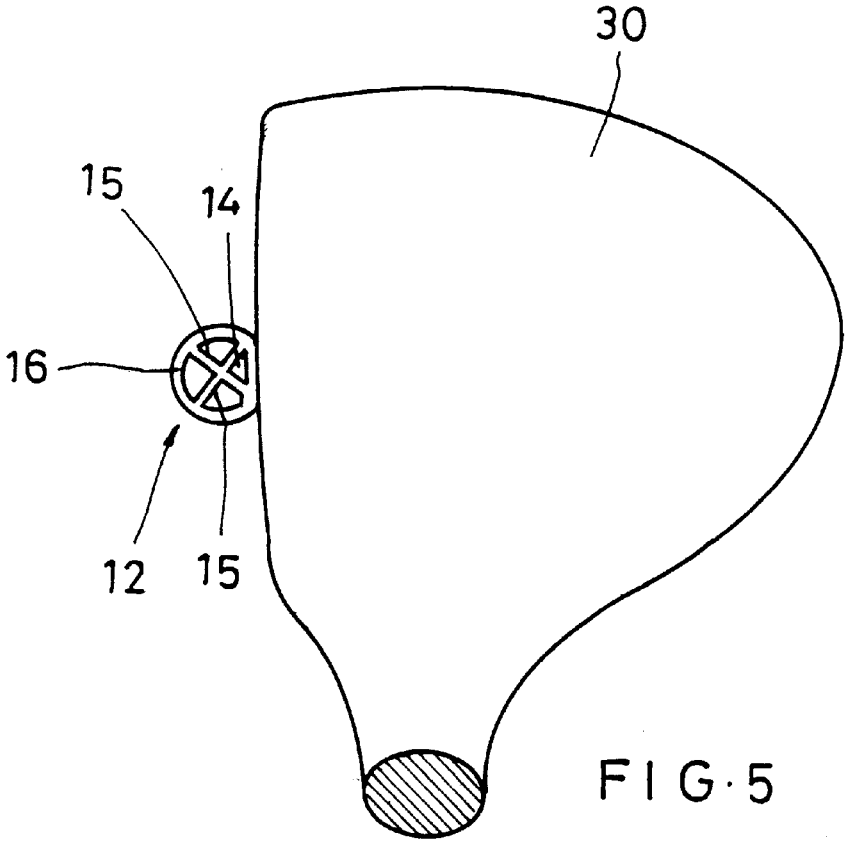
FIG. 5 is a top view of the preferred golf tee according to the present invention under a club strike.

According to the present invention, the carrier portion 12 can further comprise corresponding grooves 16 to indicate the exact position of each sub-space 14 inside the carrier portion 12. While piercing the golf tee 10 into the soil, arrange the markers 16 as shown in FIG. 4 and FIG. 5 for aligning one of interior sub-spaces 14 with the strike line, so that the club head 30 will hit the carrier portion 12 right outside a sub-space 14. This reduces the resistance to a minimum and consequently drive the golf ball 20 to a farther place.

By providing the reinforce ribs 13 and the reinforce walls 15, the strength of the golf tee 10 in accordance with the present invention can be increased. Furthermore, by providing the hollow inside of the carrier portion 12 (i.e. sub-spaces 15), the carrier portion 12 then can be elastically deformed for enhancing the striking effect. In addition, the decomposable material used for the golf tee 10 is also oriented toward the environmental protection.

In the aforesaid description, the corresponding locations of the reinforce ribs 13 and the reinforce walls 15 can be arranged at an 45 degree angular offset, so that the club head 30 will strike right at one sub-space 14 inside, while aiming at one reinforce rib 13 outside.

In the aforesaid embodiment of the golf tee 10 in accordance with the present invention, four reinforce ribs 13 and four reinforce walls 15 are included. However, in another embodiment, the number of the reinforce ribs 13 and the reinforce walls 15 can be 2, 3, 5, or any above.

The configuration of the penetration portion 11 and the carrier portion 12 is in accordance with the tooling. For example, the cross section and the length can be adjusted accordingly.

While piercing the penetration portion 11 of the golf tee 10 into the soil, the reinforce ribs 13 thereof will prevent the golf tee 10 from tilting and make the standing steadily.

The carrier portion 12 of the golf tee 10 has not only enough strength (provided by the reinforce walls 15) for practical application, but also minimize the ill-effect on the flight distance of the golf ball 20 (provided by the interior sub-spaces 15) during a ball driving.

While the present invention has been particularly shown and described with reference to preferred embodiments, it will be understood by those skilled in the art that various changes in form and detail may be without departing from the spirit and scope of the present invention.

I claim:

1. A golf tee, which is decomposable in the soil, comprising a lower penetration portion with a sharp cone-shaped tip and an upper carrier portion connected with said penetration portion for carrying a golf ball thereof on top; wherein said penetration portion having a plurality of exterior reinforcing ribs located length-wise to said tip; further wherein said carrier portion having a round hollow cross section and with a plurality of interior radial reinforcing thin walls to divide the interior space of said carrier portion into several sub-spaces; said carrier portion is constructed such that it will deform elastically when hit b a club.

* * * * *